United States Patent [19]

Kanbe et al.

[11] 4,420,546

[45] Dec. 13, 1983

[54] MEMBER FOR ELECTROPHOTOGRAPHY WITH A-SI AND C-SI LAYERS

[75] Inventors: Junichiro Kanbe, Yokohama; Tadaji Fukuda, Kawasaki, both of Japan

[73] Assignee: Canon Kabushiki Kaisha, Tokyo, Japan

[21] Appl. No.: 294,434

[22] Filed: Aug. 20, 1981

[30] Foreign Application Priority Data

Aug. 29, 1980 [JP] Japan ..... 55-120270

[51] Int. Cl.[3] ..... G03G 5/082; G03G 5/14

[52] U.S. Cl. ..... 430/57; 430/60; 430/63; 430/65; 430/84; 252/501.1; 427/74; 357/2

[58] Field of Search ..... 430/57, 60, 63, 65, 430/84, 133, 136; 252/501.1; 427/39, 74; 204/192 P; 357/2

[56] References Cited

U.S. PATENT DOCUMENTS

| | | | |
|---|---|---|---|
| 4,064,521 | 12/1977 | Carlson | 427/39 X |
| 4,217,374 | 8/1980 | Ovshinsky et al. | 430/84 X |
| 4,226,898 | 10/1980 | Ovshinsky et al. | 427/39 |
| 4,237,151 | 12/1980 | Strongin et al. | 427/74 |
| 4,253,882 | 3/1981 | Dalal | 427/74 X |
| 4,265,991 | 5/1981 | Hirai et al. | 430/84 X |
| 4,378,417 | 3/1983 | Manuyama et al. | 430/57 |

*Primary Examiner*—Roland E. Martin, Jr.
*Attorney, Agent, or Firm*—Fitzpatrick, Cella & Scinto

[57] ABSTRACT

An electrophotographic image forming member having on a substrate a photoconductive layer constructed by laminating a crystalline silicon layer and an amorphous silicon layer.

9 Claims, 3 Drawing Figures

MEMBER FOR ELECTROPHOTOGRAPHY WITH A-SI AND C-SI LAYERS

BACKGROUND OF THE INVENTION

1. Field of the Invention

This invention relates to an electrophotographic image forming member used for forming an image utilization of electromagnetic waves such as ultraviolet rays, visible rays, infrared rays, X-rays, and so forth. More particularly, this invention is concerned with an improvement in an electrophotographic image forming member having a photoconductive layer which consists of a layer of an amorphous material with silicon atom as the matrix constituent atom.

2. Description of the Prior Art

Recently, there has been made known an electrophotographic image forming member, the photoconductive layer of which is constructed with amorphous material with silicon atom as the matrix constituent atom (hereinafter abbreviated as "a-Si") - vide: for example, U.S. Pat. No. 4,225,222, U.S. Pat. No. 4,265,991, laid-open Japanese patent application No. 55-69149, etc. Such image forming member has various advantages such that it causes no environmental pollution, and has good heat-resistance, high sensitivity, durability, and so forth.

Amorphous silicon (a-Si) has heretofore been studied mostly from the standpoint of the photoconductive material for the so-called "solar battery", and its study and research as a constituent material for the photoconductive layer of the electrophotographic image forming member have just been started, hence there still remain with it several points of problem to be solved from the practical aspects.

In the first place, the deposited film of a-Si has a large stress which causes it to be readily exfoliated from a base member or substrate. In particular, when the a-Si deposited layer is to be formed on a curved surface of a drum-shaped substrate made of aluminum, etc. for the electrophotography, this peeling phenomenon is considerable.

In the second place, there has so far been hardly available the material for the substrate capable of forming a predetermined favorable electrical contact with the a-Si deposited layer, on account of which movement of electric charges through the interface between the substrate and the a-Si deposited film cannot be smooth at the time of the latent image forming process.

In the third place, sensitivity of the a-Si deposited layer to light in a long wavelength region close to the near-infrared region of the visible light is considerably lower than that to light in a shortwavelength region of the visible light.

SUMMARY OF THE INVENTION

The present invention has been made in view of the above-mentioned various disadvantages inherent in the conventionally known a-Si deposited layer.

It is therefore an object of the present invention to provide an electrophotographic image forming member having an amorphous layer of a-Si as a layer to constitute the photoconductive layer which is excellent in its adhesion and electrical contact property with the substrate.

It is another object of the present invention to provide an electrophotographic image forming member having an amorphous layer of a-Si as a layer to constitute the photoconductive layer, which is remarkably high in its sensitivity to a light in a long wavelength region of the visible light, and excellent in its electrophotographic characteristics.

According to the present invention, in general aspect thereof, there is provided an electrophotographic image forming member having a photoconductive layer constructed by lamination in the order to be mentioned, on a substrate for use in an electrophotographic process, of a crystal-line silicon layer (hereinafter abbreviated as "c-Si"), and an amorphous layer of an amorphous material containing silicon atom as a matrix constituent atom and at least one other atom selected from the group consisting of hydrogen and halogen (hereinafter abbreviated as "a-Si(H, X)" where X is halogen atom).

DETAILED DESCRIPTION OF THE PREFERRED EMBODIMENT

Figures 1, 2, 3:
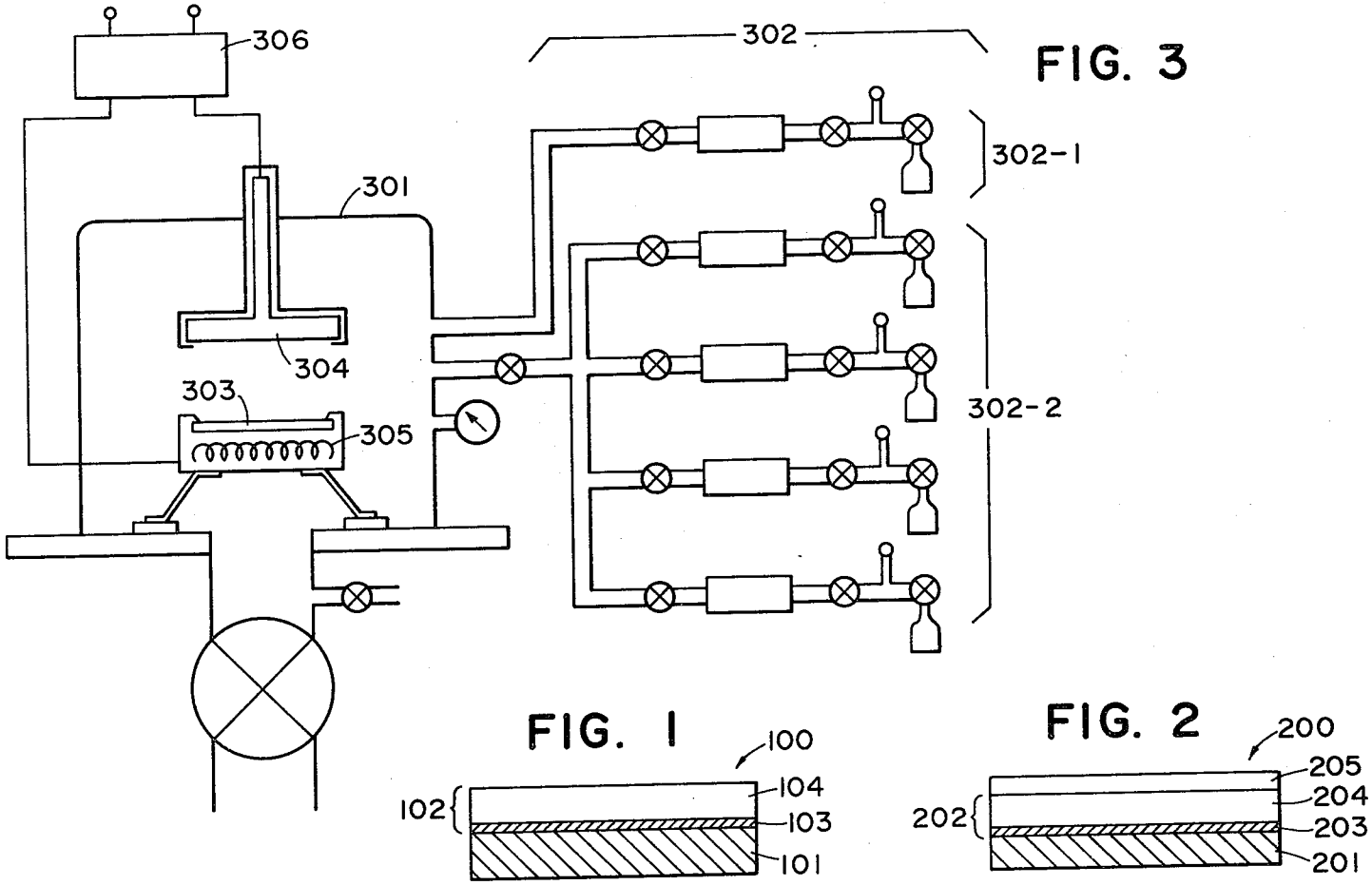
FIG. 1 is a schematic structural diagram for explaining the layer structure of one embodiment of the electrophotographic image forming member according to the present invention.
FIG. 2 is also a schematic diagram for explaining the layer structure of another embodiment of the electrophotographic image forming member according to the present invention.
FIG. 3 is a schematic diagram of one embodiment of an apparatus for fabricating the electrophotographic image forming member according to the present invention.

Referring now to FIG. 1, and electrophotographic image forming member 100 is constructed with a substrate 101, and a photoconductive layer 102 formed on the substrate 101. The photoconductive layer 102 is composed of lamination, from the side of the substrate 101, of a c-Si layer 103 and an amorphous layer 104 consisting of a-Si(H, X).

The c-Si layer 103 can be formed by the so-called "Chemical Vapor Deposition Method (CVD)", wherein poly-crystalline silicon or micro-crystalline silicon are formed by maintaining the substrate in a reaction vessel at a temperature ranging from 600° C. to 1,200° C., while causing silane gas to flow in the vessel. The layer can also be formed on the substrate 101 by the so-called "low temperature plasma decomposition method", wherein the substrate temperature is kept at 600° C. or above in a plasma reaction vessel, and a glow discharging is effected in silane gas (0.1 torr to a few torr) to grow micro-crystalline silicon or poly-crystalline silicon.

The c-Si layer 103 can further be formed by use of the substrate 101 having the epitaxial growing property, on which crystalline silicon is grown epitaxially. In still other method, the c-Si layer 103 can be formed by introducing silane gas such as $SiH_4$ and the like into a pressure-reducible reaction vessel, and irradiating laser beam such as $C0_2$ laser and the like to the silane gas to photolyze the same, thereby forming the c-Si layer 103 on the substrate 101. When a semiconductor laser in a long wavelength region such as, for example, GaAs, $Ga(As_{1-x}P_x)$, $(In_xGa_{1-x})As$, InAs, InP, InSb, etc. is used, it is possible to impart to the c-Si layer 103 a function of generating photo-carriers by absorption of the laser beam, i.e., the so-called function of "charge generating layer". Therefore the substrate should be given a layer thickness of a certain degree or above so as to efficiently absorb the irradiated laser beam.

For the sequence of laminating the layers, it is desirable that the c-Si layer 103 be provided to the side closer to the laser beam irradiation.

The amorphous layer 104 can be formed with the following three types of a-Si(H, X).

(1) n-type: This type of the layer contains donor alone, or both donor and acceptor with the donor concentration (Nd) being higher than the acceptor.

(2) p-type: This type of the layer contains acceptor alone, or both donor and acceptor with the acceptor concentration (Na) being higher than the donor.

(3) i-type: This type of the layer has a relationship of the donor and acceptor concentration of $Na \simeq Nd \simeq O$ or $Na \simeq Nd$.

For the purpose of the present invention, suitable halogen atom (X) to be contained in the amorphous layer 104 may be fluorine, chlorine, bromine, and iodine, of which fluorine and chlorine are particularly preferable.

The amorphous layer 104 composed of a-Si(H, X) can be formed by various deposition layer forming methods which are usually adopted in forming the a-Si layer such as, for example, the glow discharge method (GD method), sputtering method (SP method), ion plating method (IP method), photo-degrading method by laser irradiation, and so forth.

In order to form the amorphous layer 104 by the glow discharge method, for example, it may suffice that a raw material gas for feeding silicon which is a feeding source of silicon atom (Si) and another raw material gas for introducing halogen atom, or hydrogen atom, or both are fed into a deposition chamber, the internal pressure of which is reducible, then glow discharging is effected within the deposition chamber to form a layer composed of a-Si(H, X) on the surface of the substrate placed at a predetermined position in the deposition chamber.

In case the amorphous layer is to be formed by the sputtering method, it may suffice that, when a target made of silicon is sputtered in an atmosphere of an inert gas such as, for example, argon, helium, etc. or a mixture gas with these inert gas as the basic component, a raw material gas for introducing hydrogen atom, or halogen atom, or both be introduced into the deposition chamber.

The raw material gas for feeding silicon, which is used at the formation of the amorphous layer 104 according to the present invention is gaseous or gasifiable silicon hydride (silanes) such as $SiH_4$, $Si_2H_6$, $Si_3H_8$, $Si_4H_{10}$, etc., all of which can be used effectively. From the standpoint of readiness in handling at the layer forming process and of silicon feeding efficiency, $SiH_4$ and $Si_2H_6$ are particularly favorable.

The effective raw material gases for introducing halogen atom to be used for formation of the amorphous layer 104 according to the present invention are various halogen compounds such as, for example, halogen gases, halides, inter-halogen compounds, halogen-substituted silane derivatives (halogenated silicon), and other gaseous or gasifiable halogen compounds.

Further, halogen-containing silicon compounds with silicon atom and halogen atom as the constituent elements, which are gaseous or gasifiable, can also be used effectively in the present invention.

The halogen compounds which can be suitably used in the present invention are halogen gases such as fluorine, chlorine, bromine and iodine, and inter-halogen compounds such as BrF, ClF, $ClF_3$, $BrF_5$, $BrF_3$, $IF_7$, $IF_5$, ICl, IBr, and so forth.

For the halogen-containing silicon compounds, i.e., the so-called halogen-substituted silane derivatives, there may be enumerated halogenated silicon such as $SiF_4$, $Si_2F_6$, $SiCl_4$, $SiBr_4$ and the like.

When the second photoconductive layer is formed by the glow discharge method using such halogen-containing silicon compounds, the amorphous layer 104 composed of a-Si:X can be formed on a predetermined substrate without use of the silicon hydride gas as a raw material gas capable of feeding silicon atom.

In case the amorphous layer 104 containing therein halogen atom is fabricated in accordance with the glow discharge method, it may suffice fundamentally that silicon (halide) gas which is the raw mateiral gas for feeding silicon and a gas such as argon, helium, hydrogen, and the like are mixed at a predetermined mixing ratio and fed at a predetermined gas flow rate into the deposition chamber where the amorphous layer 104 is to be formed, and then glow discharge is created to produce a plasma atmosphere of these gases within the deposition chamber, thereby forming the amorphous layer 104 on a predetermined substrate. In this instance, a predetermined quantity of hydrogen-containing silicon compound may be further mixed with these gases for promoting introduction of hydrogen atom thereinto for the layer formation. It is also feasible that each of the gases be used not only in its simple kind, but also in mixture of a plurality of kinds of gases at a predetermined mixing ratio.

In order to form the amorphous layer 104 composed of a-Si(H, X) on the c-Si layer 103 by the reactive sputtering method or the ion plating method, the following process can be adopted. In the case of the sputtering method, a target made of silicon is used for sputtering in a predetermined gas plasma atmosphere. In the case of the ion plating method, a poly-crystalline silicon or a mono-crystalline silicon is placed on an evaporating boat as a source of the evaporative deposition, the silicon source being evaporated under heat by the resistive heating method or electron beam method (EB method) to cause the evaporated substance to pass through the predetermined gas plasma atmosphere. At this instant, for the halogen atom to be introduced into the layer formed by either the sputtering method and the ion plating method, the above mentioned halides or halogen-containing silicon compounds in a gaseous state may be introduced into the deposition chamber to form the plasma atmosphere of the gas.

When the hydrogen atom is introduced into the layer to be formed, the raw material gas for introducing hydrogen atom, e.g., hydrogen gas and silane gases, may be introduced into the sputtering deposition chamber to form the plasma atmosphere of the gas.

In the present invention, the above mentioned halides or halogen-containing silicon compounds are used as an effective raw material gas for introducing halogen atom to be used at the time of forming the amorphous layer 104. Besides these, as the starting material for forming the amorphous layer 104, there may be enumerated hydrogen halides such as HF, HCl, HBr, HI, and the like, halogen-substituted silicon hydrides such as $SiH_2F_2$, $SiH_2Cl_2$, $SiHCl_3$, $SiH_2Br_2$, $SiHBr_3$, and the like, and various other gaseous or gasifiable halides having hydrogen atom as one of the constituent elements.

The hydrogen-containing halides are capable of introducing into the amorphous layer 104 at the time of its formation not only the halogen atom, but also the hydrogen atom which is extremely effective for controlling the electric or photoelectric characteristics of the layer, hence such halides are used as a preferred halogen introducing raw material for the purpose of the present invention.

Besides the above, in order to structurally introduce hydrogen atom into the amorphous layer 104, it is also feasible that electric discharge be generated within the deposition chamber in the co-presence of hydrogen or silicon hydride gases such as $SiH_4$, $Si_2H_6$, $Si_3H_8$, $Si_4H_{10}$, and the like and a silicon compounds of introducing silicon into the layer.

For example, in the case of the reactive sputtering method, a silicon target is used, and a introducing halogen atom gas and hydrogen gas are introduced into the deposition chamber together with an inert gas such as helium, argon, and the like, depending on necessity, to thereby form a plasma atmosphere. Thereafter, the silicon target is used for sputtering to form the second photoconductive layer composed of a-Si (H, X) having a predetermined characteristics. Furthermore, gases such as $B_2H_6$, $PH_3$, $PF_3$, and the like may be introduced and such gas may also serve for doping.

Upon forming the amorphous layer 104 according to the present invention, the substrate 101 is maintained at a temperature of 200° C. to 300° C. In order that the electrophotographic characteristics, particularly, the photoelectric characteristic, may be imparted to the amorphous layer as desired, the quantity of hydrogen or halogen atom, or the quantity of hydrogen and halogen atoms to be contained in the amorphous layer 104 is usually set in a range of from 1 to 40 atomic % in an ordinary case, and preferably from 5 to 30 atomic %.

Further, attempting to increase the dark resistance and the photo-sensitivity which are important as electrophotographic properties of the amorphous layer, it is preferable to dope the amorphous layer 104 with oxygen atom, nitrogen atom, carbon atom, etc. in an amount of 0.01 to 30 atomic % in an ordinary case, and from 0.1 to 15 atomic % in a preferred case, for oxygen and nitrogen, and in an amount of from 0.1 to 50 atomic % for carbon atom.

In the present invention, carbon atom may be chemically contained in the amorphous layer 104 by the following methods. For example, in the case of a glow-discharge method for forming amorphous layer 104 a gaseous or easily gasifiable starting material for introducing carbon atom, containing carbon and hydrogen as the constituent atoms, or containing silicon, carbon and hydrogen as the constituent atoms, is introduced into the vacuum deposition chamber in its gaseous state upon forming amorphous layer 104, and is subjected to a glow discharge decomposition. As such carbon atom introducing starting material, there may be mentioned saturated hydrocarbons having a carbon content of from 1 to 5, ethylene type hydrocarbons having a carbon content of from 1 to 5, acetylene type hydrocarbons having a carbon content of from 2 to 4, and alkyl silane. For example, the saturated hydrocarbons may be: methane ($CH_4$), ethane ($C_2H_6$), propane ($C_3H_8$) n-butane (n-$C_4H_{10}$), and pentane ($C_5H_{12}$); the ethylene type hydrocarbons may be: ethylene ($C_2H_4$), propylene ($C_3H_6$), butene-1 ($C_4H_8$), butent-2 ($C_4H_8$), iso-butylene ($C_4H_8$), and pentene ($C_5H_{10}$); the acetylene type hydrocarbons may be: acetylene ($C_2H_2$), methylacetylene ($C_3H_4$), and butyne ($C_4H_6$); and alkyl silanes may be $Si(CH_3)_4$, and $Si(C_2H_5)_4$.

Besides the above, there may be further enumerated as the effective carbon atom introducing starting materials: halogen-substituted paraffin type hydrocarbons such as $CCl_4$, $CHF_3$, $CH_2F_2$, $CH_3F$, $CH_3Cl$, $CH_3Br$, $CH_3I$, $C_2H_5Cl$, and the like; fluorinated sulfur compounds such as $SF_4$, $SF_6$, and the like; and derivatives of silanes such as alkyl halogenosilane, for example, $SiCl(CH_3)_3$, $SiCl_2(CH_3)_2$, $SiCl_3CH_3$, and the like.

In order that nitrogen atom or oxygen atom may be chemically contained in the amorphous layer 104, it may suffice that, in the case of adopting a glow discharge method as used in the abovementioned case of carbon atom introduction, a raw material gas for introducing nitrogen atom or oxygen atom is introduced into the vacuum deposition chamber for forming the amorphous layer 104, and is subjected to a glow discharge decomposition.

For the starting materials which can be used effectively as the raw material gas for introducing nitrogen atom, there may be enumerated various gaseous or gasifiable nitrogen compounds such as nitrogen, nitrides, azides, and the like, for example, nitrogen ($N_2$), ammonia ($NH_3$), hydrazin ($H_2NNH_2$), hydrogen azide ($HN_3$), ammonium azide ($NH_4N_3$), and the like, in which nitrogen (N), or nitrogen (N) and hydrogen (H) are the constituent atoms. Besides the above, there may be further enumerated nitrogen halides such as nitrogen tri-fluoride ($F_3N$), nitrogen tetra-fluoride ($F_4N_2$), and the like, in view of their capability of introducing halogen atom in addition to nitrogen atom.

As the effecitve materials to be the oxygen atom introducing raw material gas, there may be used most of gaseous materials containing at least oxygen atom as the constituent atom, or gasified products of gasifiable materials containing at least oxygen atom as their constituent atom.

In case the raw material gas having silicon as the constituent atom is used, for example, there may be contemplated the following combined use of raw material gases: (1) the raw material gas with silicon as the constituent atom, the raw material gas with oxygen as the constituent atom, and, depending on necessity, the raw material gas with hydrogen or halogen, or both, as the constituent atoms are mixed at a desired mixing ratio; (2) the raw material gas with silicon as the constituent atom and the raw material gas with oxygen and hydrogen as the constituent atoms are mixed at a desired mixing ratio; or (3) the raw material gas with silicon as the constituent atom and the raw material gas with silicon, oxygen and hydrogen as the constituent atoms are mixed at a desired mixing ratio. Besides these combinations, there may be used the raw material gas with silicon and hydrogen as the constituent atoms, and the raw material gas with oxygen as the constituent atom, both being mixed at a desired mixing ratio.

Concrete examples of the oxygen atom introducing starting materials are: oxygen ($O_2$), ozone ($O_3$), carbon monoxide (CO), carbon dioxide ($CO_2$), nitrogen monoxide (NO), nitrogen dioxide ($NO_2$), dinitrogen oxide ($N_2O$), dinitrogen trioxide ($N_2O_3$), dinitrogen tetroscide ($N_2O_4$), dinitrogen pentoxide ($N_2O_5$), nitrogen trioxide ($NO_3$), lower siloxanes with silicon, oxygen and hydrogen as the constituent atoms such as di-siloxane $H_3SiOSiH_3$, tri-siloxane $H_3SiOSiH_2OSiH_3$, and so on.

In order that the carbon atom may be chemically contained in the amorphous layer 104 at its formation by sputtering, a carbon wafer or a silicon-and-carbon containing wafer used as the carbon atom introducing target is subjected to the sputtering in various gas atmospheres.

In order that nitrogen atom may be chemically contained in the amorphous layer 104 at its formation by sputtering, an $Si_3N_4$ wafer or an Si-and-$Si_3N_4$ containing wafer used as a nitrogen atom introducing target is subjected to the sputtering in various gas atmospheres.

In order that the oxygen atom may be chemically contained in the amorphous layer 104 at its formation by sputtering, an $SiO_2$ wafer or an Si-and-$SiO_2$ containing wafer used as the oxygen atom introducing target is subjected to the sputtering in various gas atmospheres.

The electrophotographic image forming member according to the present invention is provided with a c-Si layer between its substrate 101 and the amorphous layer 104 and the c-Si layer is rigidly formed on the substrate 101 by maintaining it at a high temperature. This c-Si layer functions as a kind of buffer to relax the internal stress with the consequence that no exfoliation occurs among the layers, and excellent electrical contact can be maintained among them even when the image forming member is used repetitively or under circumstances where temperature and humidity change considerably.

To render the c-Si layer 103 or the amorphous layer 104 to be an n-type or p-type conductivity, a conductivity type governing impurity, i.e., n-type impurity, or p-type impurity, or both are incorporated into the layer at its formation for doping, while controlling its doping quantity.

In this doping, by adjusting the impurity concentration in the amorphous layer in a range of from $10^{15}$ to $10^{19}$ $cm^{-3}$, there can be obtained the layer having a conductivity type ranging from a more intense n-type ($n^+$ type) to a weaker n-type ($n^-$ type) [or from a more intense p-type ($p^+$ type) to a weaker p-type ($p^-$ type)], and i-type.

For the impurities as a dopant in the amorphous layer 104 or the c-Si layer 103, there may be enumerated the Group III-A elements in the Periodic Table, such as B, Al, Ga, In, Tl, and the like to render these layers to be of the p-type conductivity, and the Group V-A elements in the Periodic Table, such as N, P, As, Sb, Bi, and the like to render them the n-type conductivity.

In the amorphous layer 104, a-Si(H, X) which is not doped with the conductivity type governing impurity (non-doped a-Si(H, X) indicates a slight tendency of the n-type conductivity ($n^-$ type). Therefore, in order to render it the i-type conductivity, a small amount of the above-mentioned p-type impurity may be contained therein.

Quantity of the impurity to be doped in the layers may be arbitrarily determined in conformity to desired electrical and optical characteristics. In the case of the Group III-A elements, an amount of from $10^{-6}$ to $10^{-3}$ atomic ratio with respect to one silicon atom is usually desirable, or, more preferably from $10^{-5}$ to $10^{-4}$ atomic ratio. In the case of the Group V-A elements, a amount of from $10^{-8}$ to $10^{-3}$ atomic ratio with respect to one silicon atom is usually desirable, or, more preferably from $10^{-8}$ to $10^{-4}$ atomic ratio.

For the substrate 101, any material which is either electrically conductive or electrically insulative may be used. The electrically conductive substrates are, for example: NiCr, stainless steel, aluminum, chromium, molybdenum, gold, niobium, tantalum, vanadium, titanium, platinum, palladium, and other metals; and alloys of these metals. The electrically insulative substrates are, for example: polyester, polyethylene, polycarbonate, cellulose acetate, polypropylene, polyvinyl chloride, polyvinylidene chloride, polystyrene, polyamide and other synthetic resins in the form of film or sheet; and glass, ceramic, artificial paper, synthetic paper, and so forth. It is desirable that these electrically insulative substrate be subjected to an electrically conductive treatment at least on its one surface, on which side the other layer be provided.

If glass is used as the substrate, the electric conductivity is imparted to its surface by providing thereon a thin film of NiCr, Al, Cr, Mo, Ir, Nb, Ta, V, Ti, Pt, Pd, $In_2O_3$, $SnO_2$, ITO($In_2O_3+SnO_2$), or the like. If the synthetic resin film such as polyester film, and the like is used, the electric conductivity is imparted thereto by forming on its surface a thin film of metals such as NiCr, Al, Ag, Pb, Zn, Ni, Au, Cr, Mo, Nb, Ta, V, Ti, Pt, and the like by the vacuum deposition, electron beam deposition, sputtering, etc., or by treating the substrate surface with lamination of the above-mentioned metals.

The shape of the substrate may be appropriately determined depending on what one might desire to have such as cylindrical form, belt form, planar form, etc. For the purpose of continuous and high speed reproduction operation, an endless belt form or a cylindrical form are desirable.

Thickness of the substrate may be arbitrarily determined in a manner such that a desired electrophotographic image forming member may be formed. In case the electrophotographic image forming member is required to have flexibility, it may be made thinnest possible within such an extent that the member can sufficiently exhibit its function as the substrate. Even in such case, however, the thickness is usually rendered 10 microns and above from the view points of manufacturing, handling, and mechanical strength of the substrate.

FIG. 2 shows another embodiment of the electrophotographic image forming member of a different layer structure according to the present invention, wherein the image forming member 200 is the same in the layer structure as that of the image forming member 100 in FIG. 1, with the exception that a surface coating layer 205 is provided on the surface of the photoconductive layer 202. That is, the electrophotographic image forming member 200 in FIG. 2 has the photoconductive layer 202 constructed with the c-Si layer 203 and the amorphous layer 204 consisting of a-Si(H, X), both being laminated on the substrate 201 in the order as mentioned, and further has the surface coating layer 205 provided on the top surface of the photoconductive layer 202. Of these layers, the forming material, fabricating conditions, layer thickness, etc. of the c-Si layer 203 and the amorphous layer 204 are the same as those in FIG. 1. In addition to its requirement for satisfying the desired electrical characteristic, the surface covering layer 205 is formed in consideration of its not giving mal-effects to the photoconductive layer 202 both chemically and physically, its electrical contact property as well as its adhesive property with the photoconductive layer 202, its moisture-resistant property, wear-resistant property, cleaning property, and so forth.

Those forming materials of the surface covering layer 205 which can be used effectively can be represented by: polyethylene terephthalate, polycarbonate, polypropylene, polyvinyl chloride, polyvinylidene chloride, polyvinyl alcohol, polystyrene, polyamide, polytetrafluoroethylene, polytrifluorochlorsethylene; polyvinyl fluoride, polyvinylidene fluoride, copolymer of hexafluoropropylene and tetrafluoroethylene, copolymer of trifluoroethylene and vinylidene fluoride, polybutene, polyvinyl butyral, polyurethane, polyparaxylylene, and other organic insulative materials: silicon nitrides, silicon oxides, and other inorganic insulative materials, etc.

Of the above-mentioned materials, the synthetic resins or cellulose derivatives may be rendered a film form to be adhered onto the photoconductive layer 204, or they are rendered a liquid form to be applied on the photoconductive layer 202 in layer. Thickness of the coating layer 205 may be arbitrarily determined depending on a desired characteristic or the material used for the image forming member. Usually, it ranges from 0.5 to 70 microns. In particular, when the surface covering layer 205 is required to have the function as the protective layer as mentioned in the foregoing, the layer thickness is 10 microns or less in an ordinary case, and when it is required to have the function as the electrically insulative layer, the layer thickness is usually 10 microns or above. It should, however, be noted that these thickness values which differentiate the layer as the protective layer on the one hand and as the electrically insulative layer on the other hand are subjected to change depending on the material to be used, the electrophotographic process to be adopted, and the structure of the image forming member to be designed.

In the present invention, thickness of the c-Si layer and that of the amorphous layer is appropriately determined as desired in accordance with the characteristics required of each layer and the interrelationship between these layers. For the c-Si layer, the thickness usually ranges from 100Å to 1 micron, or, more preferably from 500 Å to 0.5 micron. For the amorphous layer, the thickness should desirably be from 3 to 100 microns, or, more preferably from 5 to 50 microns.

FIG. 3 diagrammatically shows an apparatus for fabricating the electrophotographic image forming member. In the illustration, a reference numeral 301 designates a pressure-reducible reaction vessel, a numeral 302 refers to a gas feeding system, wherein 302-1 designates an oxygen feeding system, and 302-2 refers to feeding systems of other gases. A numeral 303 indicates a supporting member which is grounded. A numeral 304 refers to an electrode opposite to the supporting member 303, a high frequency power of 13.6 MHz being applied across the supporting member 303 and the electrode 304 by a power source 306, whereby the raw material gas introduced into the reaction vessel 301 is decomposed and deposited on the supporting member 303. A numeral 305 refers to a heater, by which a temperature of the supporting member 303 is set at a desired temperature level.

With a view to enabling those skilled in the art to reduce the present invention into practice, the following preferred examples of fabricating the electrophotographic image forming member using the fabricating apparatus as shown in FIG. 3, and of forming an electrostatic image thereon are presented, although the present invention is not limited to these examples alone.

EXAMPLE 1

In FIG. 1, the c-Si layer 103 is formed on an aluminum substrate 101 as a p-type layer having a thickness of approximately five microns by first mixing $B_2H_6$ gas with a mixture gas of $SiH_4$/He, and then doping with a large amount of boron atom ($10^{-2}$ to $10^{-3}$ atomic %) in the gas by a low pressure glow discharge method, while the amorphous layer 104 is formed to a layer thickness of about 10 microns or so by introducing $CH_4$ gas into a mixture gas of $SiH_4$/He and causing the carbon atom to be contained therein at a quantity of 1 to 30 atomic % or so by the low pressure glow discharge.

The thus obtained electrophotographic image forming member is subjected to the electrostatic image forming process. That is to say, after the positive corona charging being effected uniformly over the entire surface of the image forming member, informations are written in it by the GaAlAs laser having a wavelength of 800 nm or so. The laser beam passes through the amorphous layer 104 to excite the c-Si layer 103, and the portion of the c-Si layer irradiated by the laser beam generates free electrons. The free electrons drift toward the free surface of the a-Si layer 104 to neutralize the surface positive charge, whereby an electrostatic latent image is formed.

EXAMPLE 2

In FIG. 1, the c-Si layer 104 is formed on a stainless steel substrate 101 of a size of 100 mm×100 mm to a layer thickness of approximately 1,000 Å by first heating the substrate to a temperature of 600° C., then introducing a mixture gas of $SiH_4$/He ($SiH_4$ gas diluted with He to a concentration of 50%), and subjecting the gas to the low pressure glow discharge (at a gas pressure of 0.2 torr, and an input power of 10 W). In the next place, the amorphous layer 104 having a layer thickness of approximately 18 microns is formed by heating the substrate 101 to a temperature of 250° C., then mixing $B_2H_6$/He gas ($B_2H_6$ gas diluted with He to a concentration of 500 vol. ppm) with $SiH_4$/He gas at a ratio of 100:1 in terms of their flow rate, and subjecting the mixture gas to the low pressure glow discharge (a gas pressure of 0.2 torr, and an input power of 10 W).

The thus obtained electrophotographic image forming member is placed in a charge-exposure test apparatus to subject it to a corona charging for 0.2 second at ⊕ 6 kV immediately followed by light image irradiation. The light image irradiation is done by using a tungsten lamp as a light source with appropriate exposure quantity of 1.0 lux.sec.

Immediately after this light image irradiation, a negatively charged developer (containing a toner and a carrier) is spread in cascade on the surface of the image forming member to thereby obtain a favorable toner image on it. When the toner image on the image forming member is transferred onto an image transfer paper with corona charging of ⊕ 5.0 kV, there can be obtained a clear transfer image of high image density and good reproducibility in its gradation.

EXAMPLE 3

Various photoconductive members are fabricated in the same procedures as in Example 2 above with the exception that the forming conditions of the amorphous layer are varied.

Table 1 below shows various forming conditions of the amorphous layer, which are different from that in Example 2.

The resulting photoconductive members were used for producing images by using the apparatus as used in Example 1 and good results were obtained.

TABLE 1

| Sample No. | Raw Material Gases and Mixing Ratio in Terms of Their Flow Rate | Discharge Power | Layer Thickness |
|---|---|---|---|
| 3-1 | $SiF_4:SiH_4:Ar$ = 15:35:50 | 50W | 18μ |
| 3-2 | $SiH_4:O_2:B_2H_6$ = $1:5 \times 10^{-2}:10^{-5}$ | 30W | 10μ |
| 3-3 | $SiH_4:C_2H_4 = 1:10^{-3}$ | 50W | 10μ |
| 3-4 | $SiH_4:N_2 = 1:1$ | 80W | 15μ |
| 3-5 | $SiF_4:SiH_4:Ar:O_2$ = 15:35:50:1 | 50W | 10μ |
| 3-6 | $SiF_4:SiH_4:Ar:C_2H_4$ = $10:40:50:10^{-2}$ | 50W | 15μ |
| 3-7 | $SiF_4:SiH_4:Ar:NH_3$ = 15:35:50:1 | 50W | 15μ |

Each of the abovementioned photoconductive members is tested for the image development using the same apparatus as in Example 2 above. The results are all favorable and satisfactory.

What we claim is:

1. An electrophotographic image forming member which comprises:

(a) a substrate for use in an electrophotographic process, and (b) a photoconductive layer constructed with (i) a crystalline silicon layer from 100 Å to 1 micron in thickness overlying said substrate, and (ii) an amorphous layer from 3 to 100 microns in thickness overlying said crystalline silicon layer, wherein said amorphous layer consists essentially of an amorphous material containing silicon atom as a matrix and a member selected from the group consisting of hydrogen atom in amounts from 1 to 40 atomic percent, halogen atom in amounts from 1 to 40% and a mixture of hydrogen atom and halogen atom in amounts from 1 to 40 atomic percent.

2. The image forming member as set forth in claim 1, wherein said photoconductive layer contains at least one member selected from the group consisting of oxygen atom, nitrogen atom, and carbon atom.

3. The image forming member as set forth in claim 2, wherein the content of said oxygen atom ranges from 0.01 to 30 atomic %.

4. The image forming member as set forth in claim 2, wherein the content of said oxygen atom ranges from 0.1 to 15 atomic %.

5. The image forming member as set forth in claim 2, wherein the content of said nitrogen atom ranges from 0.01 to 30 atomic %.

6. The image forming member as set forth in claim 2, wherein the content of said nitrogen atom ranges from 0.1 to 15 atomic %.

7. The image forming member as set forth in claim 2, wherein the content of said carbon atom ranges from 0.1 to 50 atomic %.

8. The image forming member as set forth in claim 1, comprising additionally a surface covering layer on the surface of said photoconductive layer.

9. The image forming member as set forth in claim 8, wherein the layer thickness of said surface covering layer ranges from 0.5 to 70 microns.

* * * * *